US006439119B1

(12) United States Patent
Smith et al.

(10) Patent No.: US 6,439,119 B1
(45) Date of Patent: Aug. 27, 2002

(54) LOCKABLE ELECTRO-OPTICAL HIGH VOLTAGE APPARATUS AND METHOD FOR SLAPPER DETONATORS

(75) Inventors: Paul J. Smith, Silver Spring; Edward Litcher, Laurel, both of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 9 days.

(21) Appl. No.: 09/985,957

(22) Filed: Oct. 30, 2001

Related U.S. Application Data

(63) Continuation of application No. 09/594,810, filed on Jun. 16, 2000.

(51) Int. Cl.[7] ..... F42C 15/26; F42C 15/00

(52) U.S. Cl. ..... 102/221; 102/201; 102/251; 102/247

(58) Field of Search ..... 102/201, 200, 102/247, 229, 226, 222, 232, 221, 251, 254

(56) References Cited

U.S. PATENT DOCUMENTS 4,815,381 A * 3/1989 Bullard ..... 102/247
5,131,328 A * 7/1992 Chan ..... 102/254
5,206,455 A * 4/1993 Williams et al. ..... 102/201
5,247,866 A * 9/1993 O'Malley ..... 102/201
5,404,820 A * 4/1995 Hendrix ..... 102/201
5,705,767 A * 1/1998 Robinson ..... 102/231
6,167,809 B1 * 1/2001 Robinson et al. ..... 102/235
6,173,650 B1 * 1/2001 Garvick et al. ..... 102/254

* cited by examiner

*Primary Examiner*—Charles T. Jordan
*Assistant Examiner*—Lulit Semunegus
(74) *Attorney, Agent, or Firm*—Mark Homer

(57) ABSTRACT

A safe/arm apparatus includes a slider barrier having at least one notch formed therein, the slider barrier including an optically diffuse surface and an optically reflective surface; at least one mechanical lock removably disposed in the at least one notch; a linear actuator for moving the slider barrier from a safe position to an armed position; a battery; a laser diode connected to the battery, the laser diode emitting a light beam towards the optically diffuse surface when the slider barrier is in the safe position and towards the optically reflective surface when the slider barrier is in the armed position; a photodiode for receiving light reflected from the optically reflective surface; a transformer connected to the photodiode; and a capacitor connected to the transformer.

5 Claims, 4 Drawing Sheets

LOCKABLE ELECTRO-OPTICAL HIGH VOLTAGE APPARATUS AND METHOD FOR SLAPPER DETONATORS

This is a request for filing a divisional application under 37 CFR 1.53(b), of pending prior application Ser. No. 09/594,810, filed on Jun. 16, 2000, entitled LOCKABLE ELECTRO-OPTICAL HIGH VOLTAGE APPARATUS AND METHOD FOR SLAPPER DETONATORS.

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates in general to slapper detonators and in particular to a mechanically lockable interrupt for the high voltage generator section of a slapper detonator/exploding foil initiator (SD/EFI).

Fuzing/Safety&Arming (F/S&A) systems are required to meet the fail-safe requirements of MILSTD 1316D. MIL-STD 1316D sets forth the requirements for acceptable designs. Historically, the requirements have been met by the use of explosive barriers and/or an out-of-line explosive train that are held in the safe position by mechanical locks. When the mechanical locks are removed, the explosive train can be aligned (Arm mode) and is able to respond to a detonation command.

Explosives can also be detonated by using Exploding Foil Initiators (EFI) or Slapper Detonators (SD). In these devices, a high voltage and current is applied to the EFI/SD to initiate the explosives. They are commonly referred to as Electronic Safety and Arming Devices (ESAD). They are in-line explosive train and do not contain any mechanical locks. They have been approved for certain limited applications. Universally acceptable designs that have met all the intention (including immunity from single point failures) of MILSTD 1316D are still evolving.

MicroElectroMechanical Systems (MEMS) is a technology that is an outgrowth of the integrated circuit (IC) industry. It employs many common design and fabrication techniques. Whereas the IC industry process electrical devices, MEMS can also produce mechanical mechanisms on the micron scale. Because the mechanical devices are on the micron scale ($10^{-6}$), movement/forces produced are also on the micron scale ($10^{-6}$). It is difficult to move conventional macro devices (explosives/barriers) with microactuators. Since a light beam exerts no force on reflectors, it is compatible with MEMS. Combining optical circuits (fiber optics and laser diodes) and MEMS (movable reflectors) offers a unique opportunity to build MEMS systems that meet the requirements of MILSTD 1316D by using mechanically lockable devices.

SUMMARY OF THE INVENTION

In accordance with the invention a safe/arm apparatus comprises a slider barrier having at least one notch formed therein, the slider barrier including an optically diffuse surface and an optically reflective surface; at least one mechanical lock removably disposed in the at least one notch; a linear actuator for moving the slider barrier from a safe position to an armed position; a battery; a laser diode connected to the battery, the laser diode emitting a light beam towards the optically diffuse surface when the slider barrier is in the safe position and towards the optically reflective surface when the slider barrier is in the armed position; a photodiode for receiving light reflected from the optically reflective surface; a transformer connected to the photodiode; and a capacitor connected to the transformer.

In a preferred embodiment, the slider barrier includes a second notch formed therein, the apparatus further comprising a second mechanical lock removably disposed in the second notch.

Another embodiment of the invention is a safe/arm apparatus comprising a slider barrier having at least one notch formed therein, the slider barrier including first and second optically reflective surfaces; at least one mechanical lock removably disposed in the at least one notch; a linear actuator for moving the slider barrier from a safe position to an armed position: a battery; a laser diode connected to the battery, the laser diode emitting a light beam towards the first optically reflective surface when the slider barrier is in the safe position and towards the second optically reflective surface when the slider barrier is in the armed position: a light trap for receiving light reflected from the first optically reflective surface; a photodiode for receiving light reflected from the second optically reflective surface; a transformer connected to the photodiode; and a capacitor connected to the transformer.

Another aspect of the invention is a safe/arm apparatus comprising a motor; a rotor connected to the motor, the rotor having at least one notch formed therein, the rotor including an optically diffuse surface and an optically reflective surface; at least one mechanical lock removably disposed in the at least one notch; a battery; a laser diode connected to the battery, the laser diode emitting a light beam towards the rotor; a photodiode for receiving light reflected from the optically reflective surface when the rotor is in an armed state; a transformer connected to the photodiode; a rectifier connected to the transformer; and a capacitor connected to the rectifier.

In another embodiment of the invention, a safe/arm apparatus comprises a motor; a rotor connected to the motor, the rotor having at least one notch formed therein, the rotor including a first optically reflective surface and a second optically reflective surface; at least one mechanical lock removably disposed in the at least one notch; a battery; a laser diode connected to the battery, the laser diode emitting a light beam towards the rotor; a photodiode for receiving light reflected from the first optically reflective surface when the rotor is in an armed state; a light trap for receiving light reflected from the second optically reflective surface; a transformer connected to the photodiode; a rectifier connected to the transformer; and a capacitor connected to the rectifier.

The invention also includes a method of arming a fire set comprising removing at least one mechanical lock from a notch in a slider barrier; moving the slider barrier to an armed position; directing light to an optically reflective surface of the slider barrier; receiving light reflected from the optically reflective surface with a photodiode; converting the received light to electricity; transforming the electricity to a higher voltage; and storing the higher voltage electricity in a capacitor.

Yet another aspect of the invention is a method of arming a fire set comprising removing at least one mechanical lock from a notch in a rotor; rotating the rotor; directing light to the rotating rotor; receiving light reflected from an optically reflective surface of the rotor with a photodiode; converting the received light to electricity; transforming the electricity to a higher voltage; rectifying the higher voltage electricity; and storing the higher voltage electricity in a capacitor.

Further objects, features and advantages of the invention will become apparent from the following detailed description taken in conjunction with the following drawings.

BRIEF DESCRIPTION OF THE DRAWING

Throughout the Figures, reference numerals that are the same refer to the same features.

DETAILED DESCRIPTION OF THE PREFERRED EMBODIMENTS

The purpose of the invention is to provide a mechanically lockable interrupt for the high voltage generator section of a Slapper Detonator/Exploding Foil Initiator (SD/EFI) for use in the Fuzing/Safety&Arming (F/S&A) systems in weapons.

Figure 1:
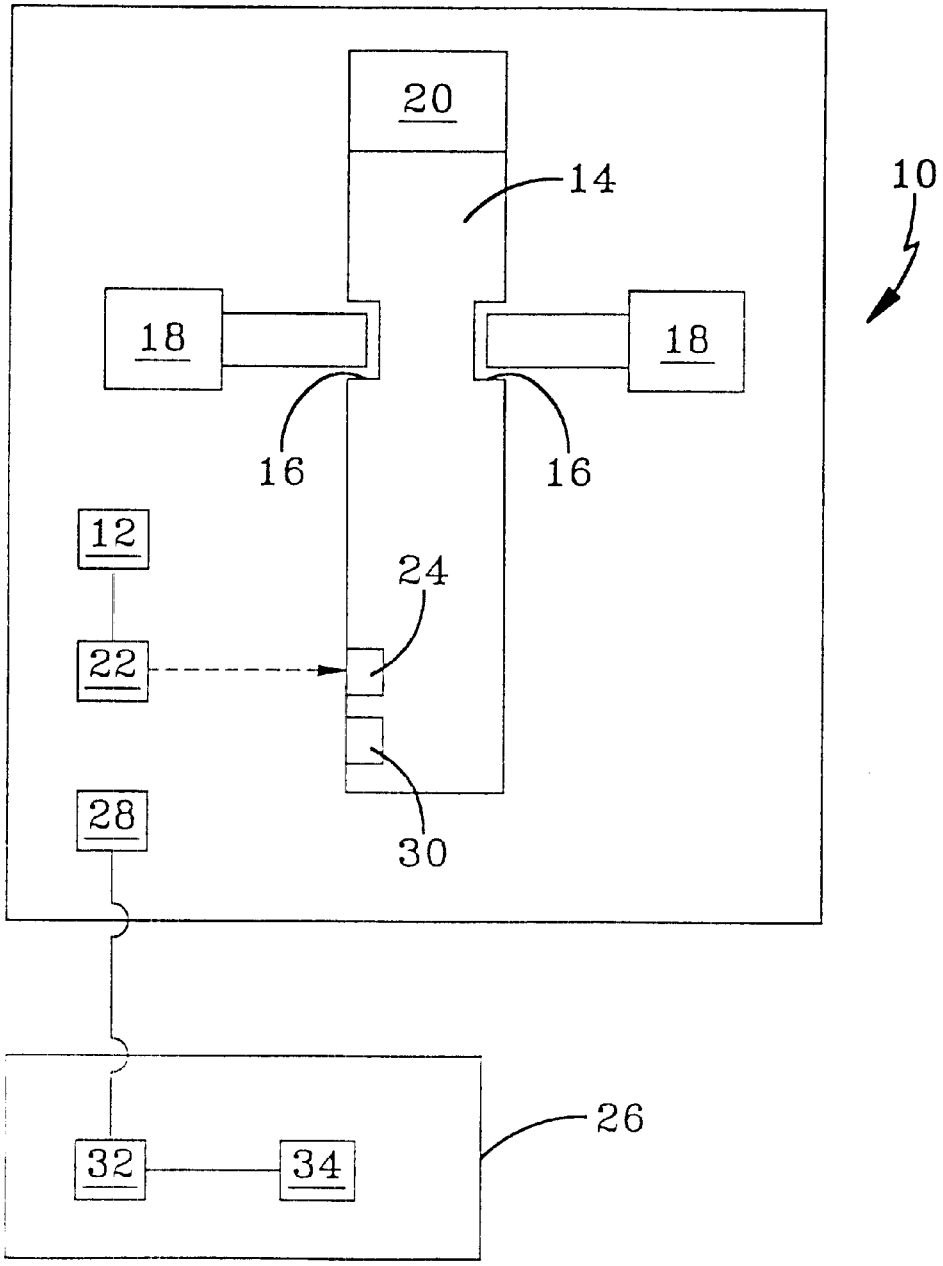
FIG. 1 is a schematic of an embodiment of the invention in the safe mode.

The function of a Safety and Arming (S&A) system is to interrupt the energy used to fire the explosive. The source of energy (electrical) is in the form of a low voltage and current. The system (EFI/SD) requires a source of high voltage and current (short duration) to detonate the explosives. In the present invention, electrical energy is converted to light (using a LED/Laser Diode) and the light interacts with movable/lockable MEMS reflectors. The reflective light beam is converted to electrical energy by a photodetector. The electrical energy is stored until required FIG. 1 is a schematic of an embodiment of the invention in the safe mode. The safe/arm module 10 includes a slider barrier 14 having at least one notch 16 formed therein. FIG. 1 shows two notches 16. The slider barrier includes an optically diffuse surface 24 and an optically reflective surface 30. At least one mechanical lock 18 is removably disposed in the at least one notch 16. FIG. 1 shows two mechanical locks 18, each removably disposed in a notch 16. A linear actuator 20 is attached to the slider barrier 14. The linear actuator 20 moves the slider barrier from a safe position to an armed position (FIG. 2) when the mechanical locks 18 are released.

A battery 12 supplies electrical power (for example, 1.5 volts) to a laser diode or LED 22. The laser diode 22 emits a light beam toward the optically diffuse surface 24 when the slider barrier is in the safe position. Thus, the light beam is diffused.

Figure 2:
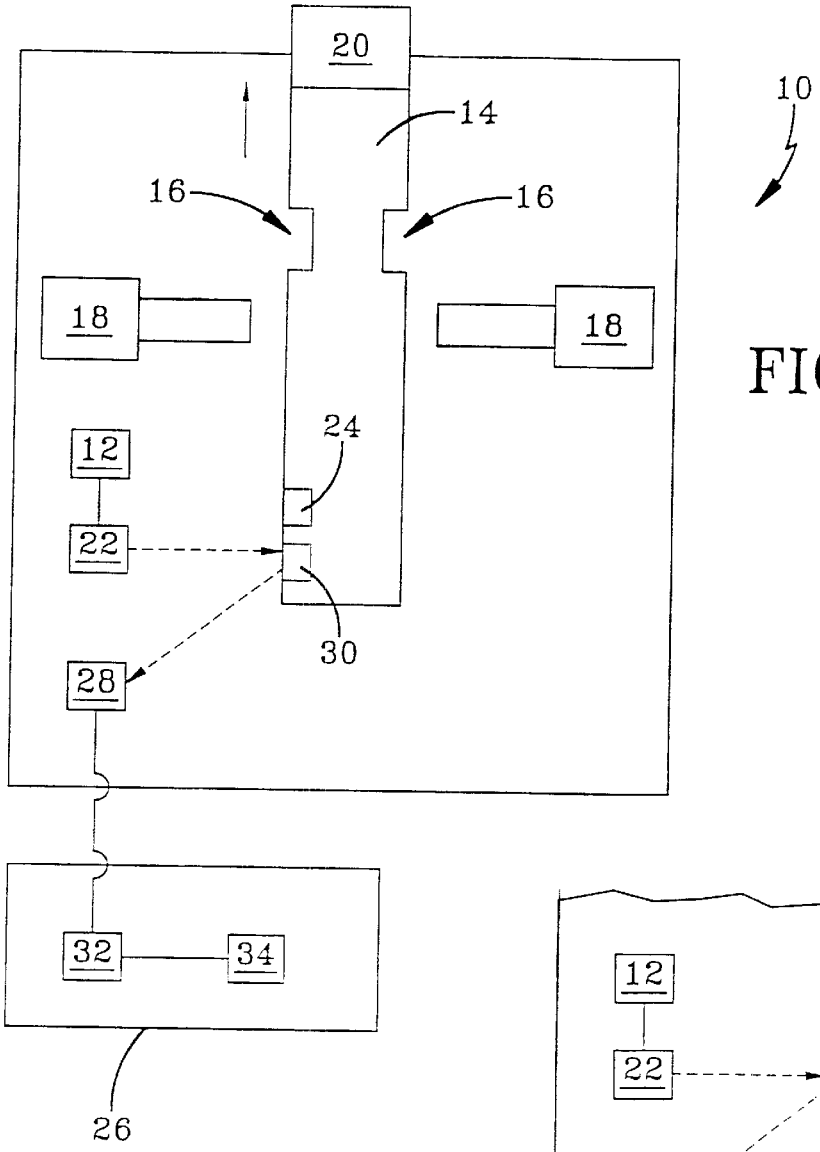
FIG. 2 is a schematic of the embodiment of FIG. 1 in the armed mode.

Referring now to FIG. 2, when the slider barrier is in the armed position, the laser diode 22 emits a light beam toward the optically reflective surface 30. The optically reflective surface 30 reflects the light beam to the photodiode 28. The photodiode converts the light beam to an electric current. The electric current flows to a transformer 32 where the voltage is stepped up. The high voltage electrical energy is stored in a capacitor 34, which is part of the electrical circuit in the high voltage side of a fire set 26, such as a slapper detonator or an exploding foil initiator. The high voltage electrical energy stored in capacitor 34 is used to initiate the detonation process.

The mechanical locks 18 are controlled by post launch sensors which remove the locks from the slider barrier when the requirements of MILSTD 1316D have been met. The mechanical locks 18 may be, for example, a pressure sensitive hydrostat, a thermal actuator or a magnetic actuator controlled by flow sensors. The linear actuator may be, for example an electromagnetic or thermal actuator. The length of travel of the slider barrier 14 from the safe position to the armed position is on the order of 500 microns.

Figure 3:
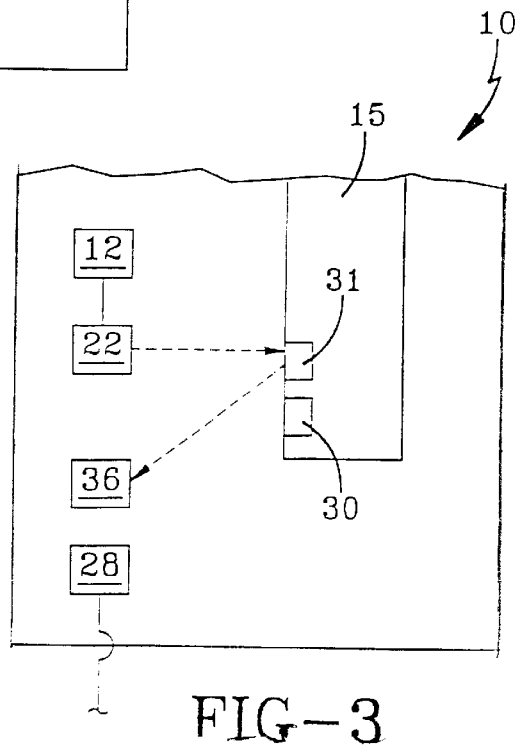
FIG. 3 is a partial schematic of a modification of the embodiment of FIGS. 1 and 2.

FIG. 3 is a partial schematic of a modification of the embodiment of FIGS. 1 and 2. The slide barrier 15 of FIG. 3 differs from slider barrier 14 of FIGS. 1 and 2. Slider barrier 15 includes first and second optically reflective surfaces 31, 30 and no optically diffuse surface 24. The laser diode 22 emits a light beam towards the first optically reflective surface 31 when the slider barrier 15 is in the safe position. The first optically reflective surface 31 i angled such that it reflects the light beam into a light trap 36. When the mechanical locks 18 are disengaged and the slider barrier moves to the armed position, the laser diode 22 emits a light beam towards the second optically reflective surface 30. The second optically reflective surface 30 reflects the light beam to photodiode 28 and the module functions as described before.

Figure 4A:
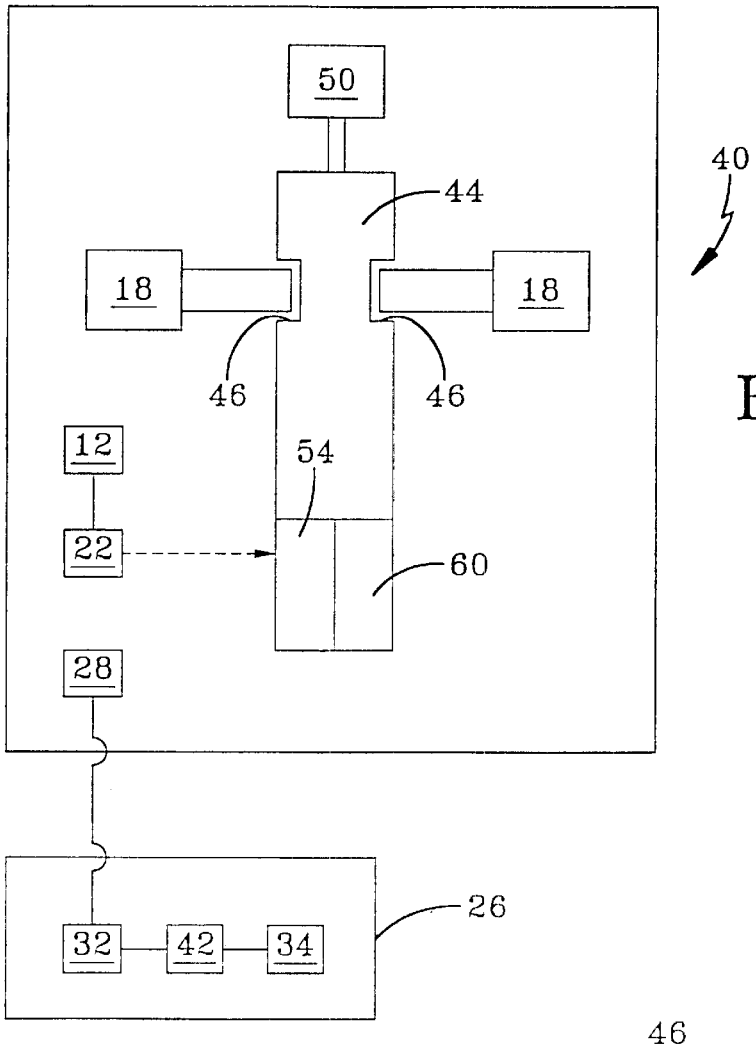
FIG. 4(A) is a schematic of another embodiment of the invention in the safe mode.
Figure 4B:
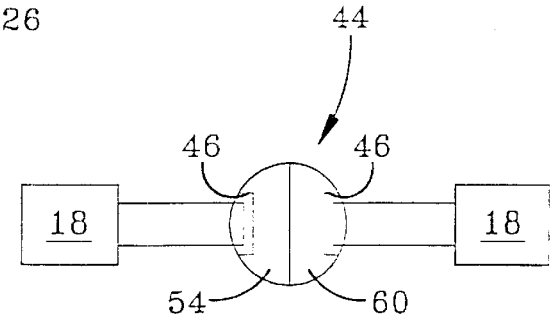
FIG. 4(B) is a schematic end view of a rotor in the safe mode.
Figure 5:
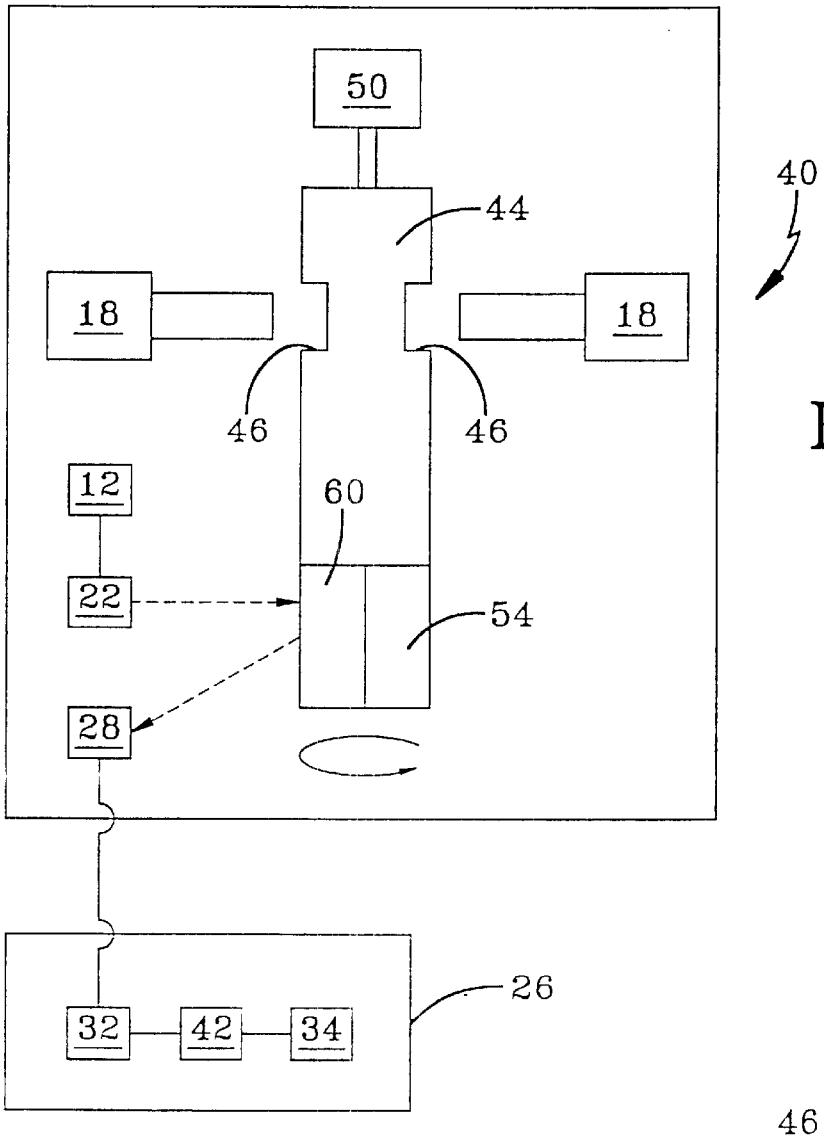
FIG. 5 is a schematic of the embodiment of FIG. 4(A) in the armed mode.

FIG. 4(A) is a schematic of another embodiment of the invention in the safe mode. FIG. 4(B) is a schematic end view of a rotor in the safe mode. FIG. 5 is a schematic of the embodiment of FIG. 4(A) in the armed mode. The safe/arm module 40 includes a motor 50 and a rotor 44 connected to the motor 50. The rotor 44 has at least one notch 46 formed therein. The rotor 44, includes an optically diffuse surface 54 and an optically reflective surface 60. At least one mechanical lock 18 is removably disposed in the at least one notch 46. FIG. 4(A) shows two notches 46 and two mechanical locks 18. The motor 50 spins the rotor 44 (FIG. 5) when the mechanical locks 18 are released. The motor 50 may be, for example, a powered MEMS motor or powered by water flow over a turbine wheel.

A battery 12 supplied electrical power (for example, 1.5 volts) to a laser diode or LED 22. The laser diode 22 emits a light beam toward the optically diffuse surface 54 when the rotor 44 is in the safe position. Thus, the light beam is diffused.

Referring now to FIG. 5, when the rotor 44 is in the armed position, the laser diode 22 emits a light beam toward the optically reflective surface 60. The optically reflective surface 60 reflects the light beam to the photodiode 28. As the rotor 44 continues to spin the light beam strikes the optically diffuse portion 54 of the rotor and does not reach the photodiode 28. The photodiode 28 converts the alternating (bright/dark) light beam into an alternating electrical current. The electric current flows to a transformer 32 where the voltage is stepped up. The alternating voltage is converted to a constant value by rectifier 42 and stored in a capacitor 34. The high voltage electrical energy is stored in a capacitor 34, which is part of the electrical circuit in the high voltage side of a fire set 26, such as a slapper detonator or an exploding foil initiator. The high voltage electrical energy stored in capacitor 34 is used to initiate the detonation process.

Figure 6:
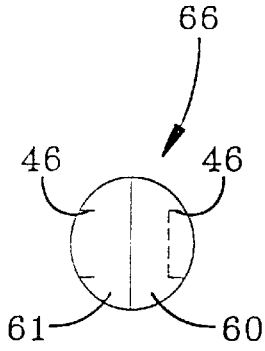
FIG. 6 is a schematic end view of a modification of the rotor of FIGS. 4 and 5.

FIG. 6 is a schematic end view of a modification of the rotor of FIGS. 4 and 5. The rotor 66 of FIG. 6 differs from rotor 44 of FIGS. 4 and 5. Rotor 66 includes first and second optically reflective surfaces 61, 60 and no optically diffuse surface 54. The laser diode 22 emits a light beam towards the first optically reflective surface 61 when the rotor 66 is in the safe (locked) position. The first optically reflective surface 61 is angled such that it reflects the light beam into a light trap 36, as shown in FIG. 3. When the mechanical locks 18 are disengaged and the rotor 66 spins (armed position), the laser diode 22 emits a light beam towards the second optically reflective surface 30. The second optically reflective surface 30 reflects the light beam to photodiode 28. As the rotor 44 continues to spin, the light beam strikes the first optically reflective surface 61 of the rotor and the light beam does not reach the photodiode 28. The photodiode 28 converts the alternating (bright/dark) light beam into an alternating electrical current and the module functions as described before.

The rotor 44 could have several reflective surfaces that direct the light beam into separate photodiodes 28 to create multiphase voltages. To increase power transfer (or allow lower power light sources), multiple pairs of laser diodes 22 and photodiodes 28 could be used in conjunction with a single rotor 44.

The invention may also be used to transmit data to and from the fire set 26. In the case of the embodiments with the slider barrier 14, the light beam from the laser diode 22 can be frequency modulated to carry data. The data may be, for example, required clocking for the oscillator in a voltage transformer circuit, a fire command or a command to remove the slapper detonator protective shunts. In the case of the embodiments with the rotor 44, 66, the light beam would be modulated at a rate faster than the frequency of the rotor 44, 66. Because two light beams do not interfere with each other, data can be sent from the high voltage section of the EFI/SD to the low voltage arm/safe module using the same reflective surfaces. For example, data such as status information about the EFI/SD system can be sent from the high voltage section to the low voltage section of the F/S&A system. This allows total electrical isolation, including ground paths, between the high and low voltage sections.

EFI/SD use only secondary explosives thereby eliminating the most sensitive explosive component in a warhead fire train. The present invention provides EFI/SD with a mechanical lockable energy switch for inherent improved safety and reliability. The mechanical locks 18 can be purely mechanical and immune to electrical failures thereby improving the inherent safety of the warhead. The mechanical lock position may be directly viewed to give a visual indication of the mode of the device (Safe Mode/Armed Mode).

The present invention provides complete electrical isolation between the low voltage circuits and high voltage circuits. The use of three sequential energy transformations (electrical/optical/electrical) prevents inadvertent activation by a failure in the electronics system. The invention is immune to mal-assembly of the slider barrier 14, 15 or rotor 44, 66. If the slider barrier 14, 15 or rotor 44, 66 is missing the unit will fail in the safe mode. The invention is immune to "quick" arm times, because energy must be integrated over a series of pulses in the high voltage section prior to reaching the EFI/SD minimum threshold. If the system fails (no movement of slider barrier 14, 15 or rotation of rotor 44, 66), it will not transfer energy to reach the arm mode.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A safe/arm apparatus comprising:

a motor;

a rotor connected to the motor, the rotor having at least one notch formed therein, the rotor including an optically diffuse surface and an optically reflective surface;

at least one mechanical lock removably disposed in the at least one notch;

a battery;

a laser diode connected to the battery, the laser diode emitting a light beam towards the rotor;

a photodiode for receiving light reflected from the optically reflective surface when the rotor is in an armed state;

a transformer connected to the photodiode;

a rectifier connected to the transformer; and a capacitor connected to the rectifier.

2. The safe/arm apparatus of claim 1 wherein the motor is powered by one of electricity and a flow of water over a turbine.

3. The safe/arm apparatus of claim 1 wherein the at least one mechanical lock is one of a pressure sensitive hydrostat, a thermal actuator and a magnetic actuator controlled by flow sensors.

4. The safe/arm apparatus of claim 1 wherein the rotor includes a second notch formed therein, the apparatus further comprising a second mechanical lock removably disposed in the second notch.

5. A safe/arm apparatus comprising:

a motor;

a rotor connected to the motor, the rotor having at least one notch formed therein, the rotor including a first optically reflective surface and a second optically reflective surface;

at least one mechanical lock removably disposed in the at least one notch;

a battery;

a laser diode connected to the battery, the laser diode emitting a light beam towards the rotor;

a photodiode for receiving light reflected from the first optically reflective surface when the rotor is in an armed state;

a light trap for receiving light reflected from the second optically reflective surface;

a transformer connected to the photodiode;

a rectifier connected to the transformer; and a capacitor connected to the rectifier.

* * * * *